US012123302B2

(12) United States Patent
Garcia et al.

(10) Patent No.: US 12,123,302 B2
(45) Date of Patent: Oct. 22, 2024

(54) DOWNHOLE SEGREGATION FOR WIRELINE FORMATION FLUID SAMPLING

(71) Applicant: Schlumberger Technology Corporation, Sugar Land, TX (US)

(72) Inventors: German Garcia, Katy, TX (US); Hadrien Dumont, Paris (FR); Vinay Kumar Mishra, Katy, TX (US)

(73) Assignee: SCHLUMBERGER TECHNOLOGY CORPORATION, Houston, TX (US)

( * ) Notice: Subject to any disclaimer, the term of this patent is extended or adjusted under 35 U.S.C. 154(b) by 0 days.

(21) Appl. No.: 17/754,390

(22) PCT Filed: Oct. 1, 2020

(86) PCT No.: PCT/US2020/053740
§ 371 (c)(1),
(2) Date: Mar. 31, 2022

(87) PCT Pub. No.: WO2021/067561
PCT Pub. Date: Apr. 8, 2021

(65) Prior Publication Data

US 2022/0341318 A1 Oct. 27, 2022

Related U.S. Application Data

(60) Provisional application No. 62/908,958, filed on Oct. 1, 2019.

(51) Int. Cl.
*E21B 49/08* (2006.01)
*E21B 23/06* (2006.01)
*E21B 33/12* (2006.01)

(52) U.S. Cl.
CPC ..... *E21B 49/081* (2013.01); *E21B 23/06* (2013.01); *E21B 33/1208* (2013.01)

(58) Field of Classification Search
USPC ..... 166/264
See application file for complete search history.

(56) References Cited

U.S. PATENT DOCUMENTS 5,540,280 A * 7/1996 Schultz ..... E21B 27/02 166/264
6,722,432 B2 * 4/2004 Spiers ..... E21B 49/0813 166/264

(Continued)

FOREIGN PATENT DOCUMENTS

GB 2390105 A 12/2003
WO 2008011189 A1 1/2008
WO 2017040457 A2 3/2017

OTHER PUBLICATIONS

Extended Search issued in European Patent Application No. 20872813.9 dated Aug. 9, 2023, 8 pages.

(Continued)

*Primary Examiner* — Taras P Bemko
(74) *Attorney, Agent, or Firm* — Trevor G. Grove

(57) ABSTRACT

The disclosure provides for a method for sampling fluid from a subterranean formation that is intersected by a wellbore. The method includes performing an initial drawdown at a target interval in the wellbore to pump fluid from the subterranean formation with a 3D radial probe. The method includes isolating the target interval of the wellbore with a packer and providing a residence time within a dead volume of the packer to allow fluid therein to separate into hydrocarbon and water phases. The method includes pumping a sample of the hydrocarbon into a sample chamber while pumping a remainder of the fluid into the wellbore, and testing the sample to determine a hydrocarbon content of the sample.

17 Claims, 13 Drawing Sheets

(56) References Cited

U.S. PATENT DOCUMENTS

| | | | | |
|---|---|---|---|---|
| 2004/0087448 | A1 | 5/2004 | Smith et al. | |
| 2005/0155760 | A1* | 7/2005 | Hill | E21B 49/10 166/264 |
| 2006/0000603 | A1 | 1/2006 | Zazovsky et al. | |
| 2008/0105032 | A1 | 5/2008 | Reddy et al. | |
| 2009/0156877 | A1* | 6/2009 | Newman | C10G 1/045 585/833 |
| 2009/0183882 | A1* | 7/2009 | van Zuilekom | E21B 49/081 166/371 |
| 2011/0163017 | A1 | 7/2011 | Johnson | |
| 2011/0198078 | A1 | 8/2011 | Harrigan et al. | |
| 2013/0068463 | A1 | 3/2013 | Landsiedel | |
| 2014/0224474 | A1* | 8/2014 | Cernosek | E21B 49/00 166/107 |
| 2015/0361791 | A1* | 12/2015 | Gisolf | E21B 49/008 166/264 |
| 2018/0119547 | A1* | 5/2018 | Slapal | E21B 21/10 |
| 2020/0317981 | A1* | 10/2020 | Mohamed | C09K 8/16 |
| 2021/0025840 | A1* | 1/2021 | Ye | E21B 49/08 |
| 2021/0062650 | A1* | 3/2021 | Molla | G01N 33/2823 |

OTHER PUBLICATIONS

Kazakevich, E. et al., "The First Application of Wireline 3D Radial Probe for Determination of Permeability and Mobile Fluid Type in Highly Water Saturated Rocks in the Piltun-Astokhskoye Field", SPE 182559-MS, presented at the SPE Annual Caspian Technical Conference Exhibition, Astana, Kazakhstan, 2016, 9 pages.

Mishra, V. K. et al., "Downhole Fluid Sampling and Analysis in Challenging Reservoirs Using 3D Radial Probe Case Study from Deepwater Gulf of Mexico", SPE 181704-MS, presented at the SPE Annual Technical Conference and Exhibition, Dubai, UAE, 2016, 12 pages.

Mullins, O.C. et al., "Downhole Fluid Analysis and Gas Chromatography; a Powerful Combination for Reservoir Evaluation", Petrophysics, 2018, 59(5), pp. 649-671.

International Preliminary Report on Patentability issued in PCT Application PCT/US2020/053740 dated Apr. 14, 2022, 10 pages.

International Search Report and Written Opinion issued in PCT Application PCT/US2020/053740, dated Jan. 20, 2021 (14 pages).

* cited by examiner

DOWNHOLE SEGREGATION FOR WIRELINE FORMATION FLUID SAMPLING

CROSS-REFERENCE TO RELATED APPLICATIONS

This application is a National Stage of International Application No. PCT/US2020/053740, filed Oct. 1, 2020, which claims the benefit of U.S. Provisional Application No. 62/908,958, filed Oct. 1, 2019, the disclosure of which is incorporated herein by reference in its entirety.

FIELD

The present disclosure relates to methods, apparatus and systems for formation fluid sampling in wellbores.

BACKGROUND

During oil and gas drilling operations, after a borehole is drilled, formation evaluations are performed to measure and analyze the properties of the formation fluid therein, including assessing a quantity and producibility of fluids (e.g., oil) therein. Formation evaluations can be used to determine various actions, such as the viability of a formation for production, as well as which interval(s) of a wellbore should be targeted for production purposes.

In some wells, the ability to obtain a representative sample of formation fluid for evaluation is challenging, such as in low-permeability formations in wells that are drilled with water-based mud (WBM), including those with severe skin damage. Such wells are not uncommon in, for example, the north slope of Alaska.

BRIEF SUMMARY

One embodiment of the present disclosure includes a method for sampling fluid from a subterranean formation that is intersected by a wellbore. The method includes isolating a section of the wellbore with a fluid tester. The fluid tester includes an inlet. Isolating the section of the wellbore with the fluid tester includes providing a space between the inlet of the fluid tester and the subterranean formation. The method includes pumping a fluid mixture from the subterranean formation into the wellbore and into the inlet of the fluid tester. During the pumping, the fluid mixture enters the space and at least partially separates within the space into at least two phases. The at least two phases include a hydrocarbon-based phase and a water-based phase. When the hydrocarbon-based and water-based phases enter the inlet of the fluid tester, the method includes pumping a sample of at least a portion of the hydrocarbon-based phase with a first pump from the fluid tester inlet to a sample chamber and using a second pump to pump a remainder of fluid from the fluid tester inlet into the wellbore. The second pump exhibits a higher pump rate than a pump rate of the first pump. The method includes testing a hydrocarbon content of the sample.

Another embodiment of the present disclosure includes a method for sampling fluid from a subterranean formation that is intersected by a wellbore. The method includes performing an initial draw-down at a target interval in the wellbore, including pumping fluid from the subterranean formation using a first fluid tester. The method includes isolating the target interval of the wellbore with a second fluid tester that includes an inlet. A dead volume is present between the inlet of the second fluid tester and the subterranean formation. The method includes pumping a fluid mixture from the subterranean formation into the dead space and into the inlet of the second fluid tester. During the pumping, the fluid mixture at least partially separates within the dead space into at least two phases, including a hydrocarbon-based phase and a water-based phase. The method includes pumping a sample of at least a portion of the hydrocarbon-based phase with a first pump from the inlet of the second fluid tester to a sample chamber, and using a second pump to pump a remainder of fluid from the inlet of the second fluid tester into the wellbore. The second pump exhibits a higher pump rate than a pump rate of the first pump. The method includes testing the sample to determine a hydrocarbon content of the sample.

Another embodiment of the present disclosure includes a method for sampling fluid from a subterranean formation that is intersected by a wellbore. The method includes: a) performing an initial draw-down at a first target interval in the wellbore, including pumping fluid from the subterranean formation using a first fluid tester; b) isolating the first target interval of the wellbore with a second fluid tester; c) pumping a fluid mixture from the subterranean formation and into a dead space between the subterranean formation and an inlet of the second fluid tester, wherein, during a residence time within the dead space, the fluid mixture containing mud and hydrocarbon separates into at least two phases that include a water-based phase and a hydrocarbon-based phase; d) pumping a first sample of the hydrocarbon-based phase into a sample chamber while pumping a remainder of the fluid into the wellbore; e) testing the first sample to determine a hydrocarbon content of the first sample; f) repeating steps 'a' through 'e' at a second target interval in the wellbore to determine a hydrocarbon content of a second sample; and g) comparing the hydrocarbon content of the first sample with the hydrocarbon content of the second sample.

BRIEF DESCRIPTION OF THE DRAWINGS

So that the manner in which the features of the apparatus, systems and methods of the present disclosure may be understood in more detail, a more particular description is provided with reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Figure 1A:
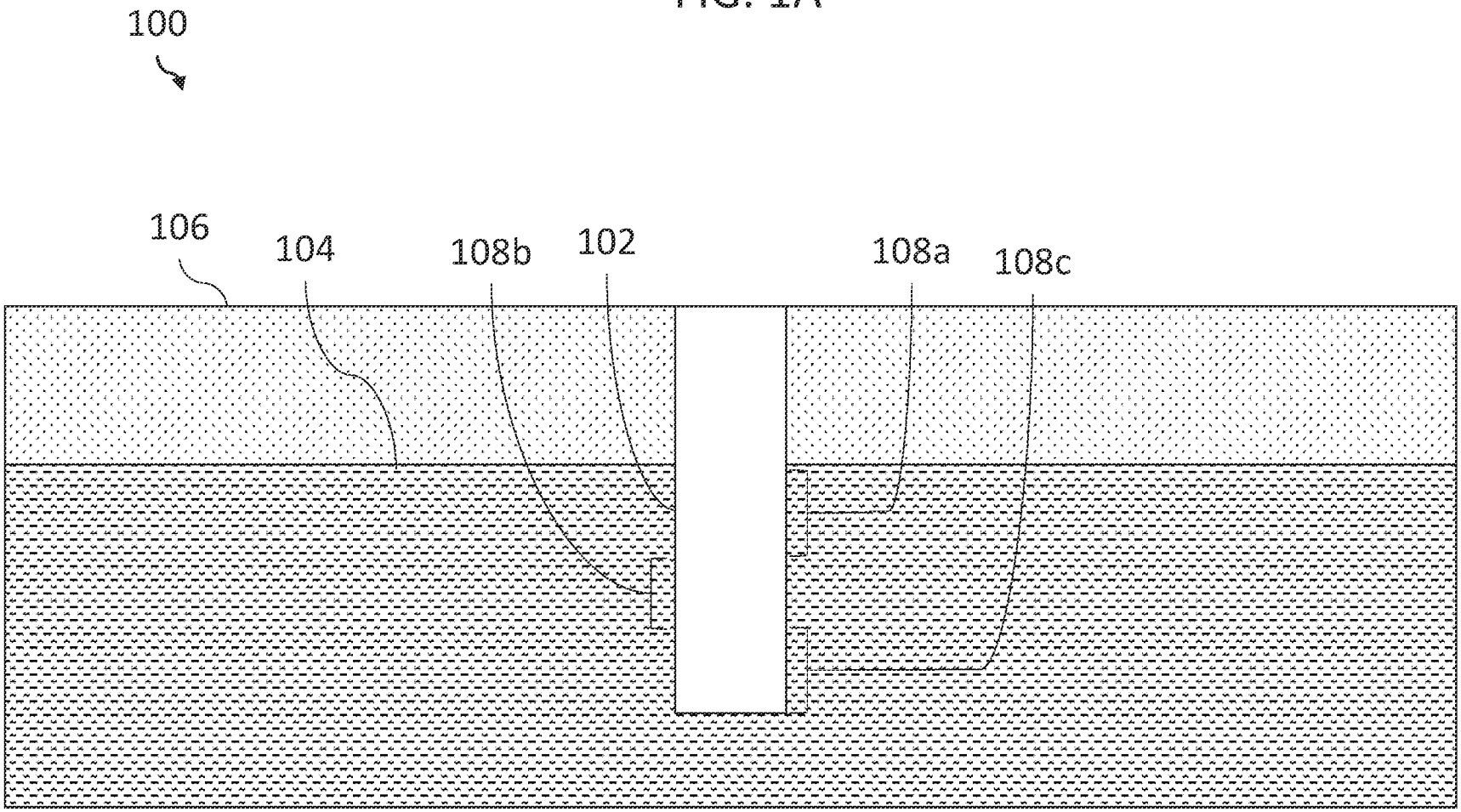
FIG. 1A depicts a wellbore.

Methods, apparatus, and systems according to present disclosure will now be described more fully with reference to the accompanying drawings, which illustrate various exemplary embodiments.

DETAILED DESCRIPTION

The present disclosure includes methods, apparatus and systems for formation fluid sampling in wellbores. In some embodiments, the methods, apparatus and systems disclosed herein provide for the segregation of formation fluid from, for example, mud filtrate, providing for relatively high-quality formation fluid samples. In some such embodiments, the methods, apparatus and systems disclosed herein exploit gravity and residence time within the wellbore to segregate formation fluid from other fluids. After the formation fluid has been segregated, the methods, apparatus and systems disclosed herein provide for the selective collection of samples of the formation fluid from the well, such as by selectively pumping the formation fluid and other fluids in different directions. For example, the formation fluid may be pumped upwards, towards the opening of the wellbore, while the other fluids are pumped downwards, deeper into the wellbore. The methods, apparatus and systems disclosed herein include procedures, techniques, and hardware used to segregate and collect such formation fluid samples.

Certain embodiments of the disclosure include methods for sampling formation fluid in wellbores. In some such embodiments, the methods include sampling formation fluid in wellbores having been drilled with water-based mud (WBM), also referred to as water mud. Water-based mud is a drilling fluid (mud) that includes water as the major liquid phase thereof, and as the wetting (external) phase thereof. Water-based muds can include fresh WBM, seawater WBD, lime mud, low-solids mud, low-solids/nondispersed mud (i.e., low-solids mud with no clay deflocculant chemical), potassium, and silicate. In some embodiments, the methods, apparatus and systems disclosed herein include downhole fluid segregation to collect relatively high-quality formation fluid samples with wireline formation testers in wells that have been drilled with WBM and have relatively severe skin damage. As would be understood by one skilled in the art, "skin" is a dimensionless factor calculated to determine the production efficiency of a well by comparing actual conditions with theoretical or ideal conditions, where a positive skin value indicates some damage or influences that are impairing well productivity and a negative skin value indicates enhanced productivity, typically resulting from stimulation. Also, one skilled in the art would understand that "damage", as used with respect to "skin", refers to natural or induced production impairments that can develop in the reservoir, the near-wellbore area, the perforations, the gravel-pack completion or the production pipelines, such as the tubing. The methods disclosed herein are not limited to being used in the specific types of wells discussed herein (e.g., wells drilled with WBM), and may be used for the sampling of formation fluids in other types of wells.

The formations that may be sampled using the methods disclosed herein include relatively low-permeability formations (i.e., formations that do not readily transmit fluids, such as shales and siltstones). One exemplary region in which the methods, apparatus, and systems disclosed herein may be applied is the north slope of Alaska. However, the methods disclosed herein are not limited to being used in these particular formations, and may be used in other formations for the sampling of formation fluids.

Method of Sampling Formation Fluid

One exemplary embodiment of the method disclosed herein will be descried with reference to FIGS. 1A-3C which schematically depict the sampling of formation fluid within a wellbore.

With reference to FIG. 1A, wellsite 100 is depicted, including wellbore 102 intersecting formation 104 beneath surface 106. Wellbore 102 may, of course, include any of various typical components of a wellbore, such as casing. The method includes selecting a target interval of wellbore 102 for fluid sampling. In FIG. 1A, wellbore 102 is indicated as having three potential target intervals 108*a*-108*c*.

Figure 1B:
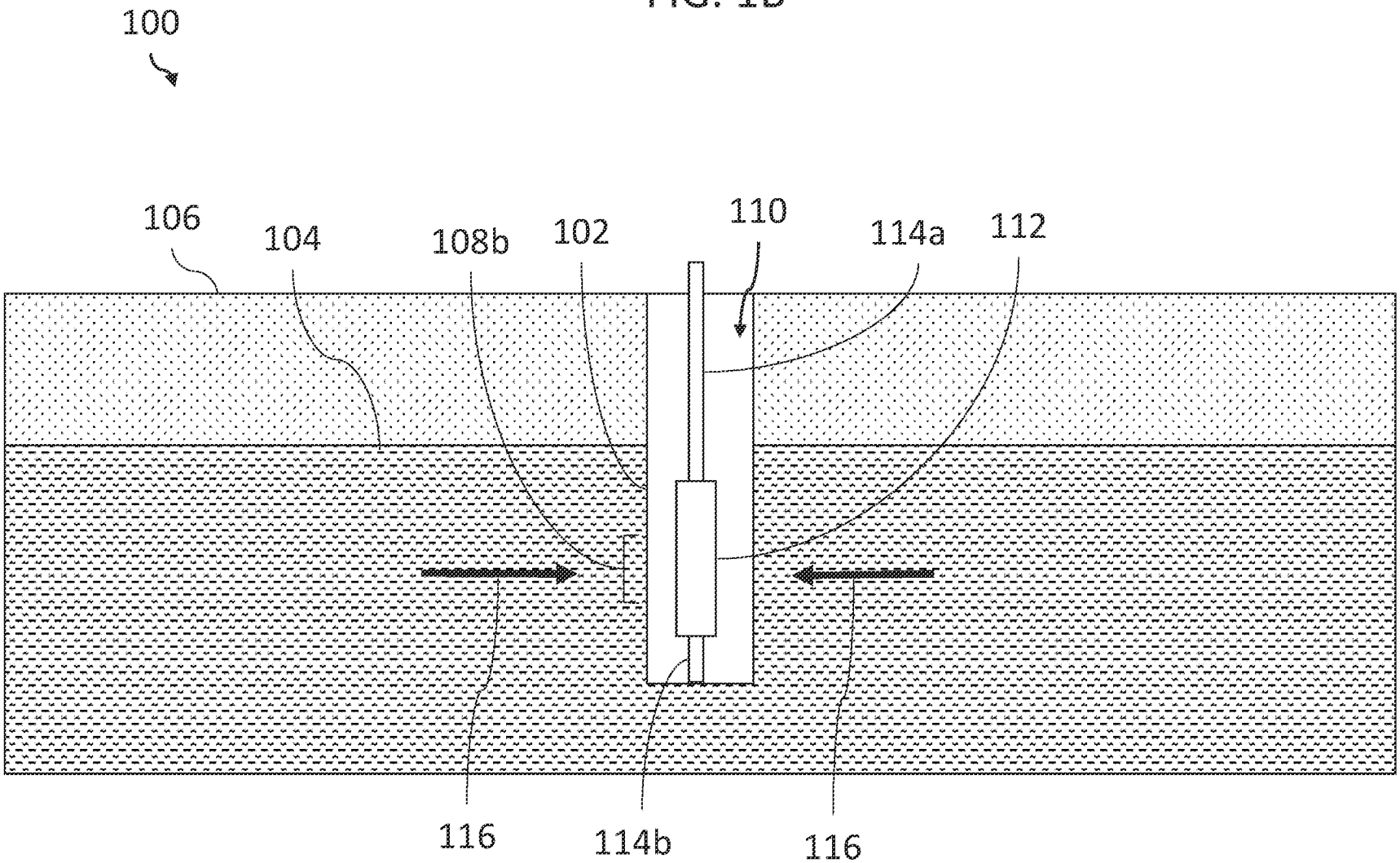
FIG. 1B depicts a 3D radial probe intersecting a target interval of the wellbore of FIG. 1A.
Figure 1C:
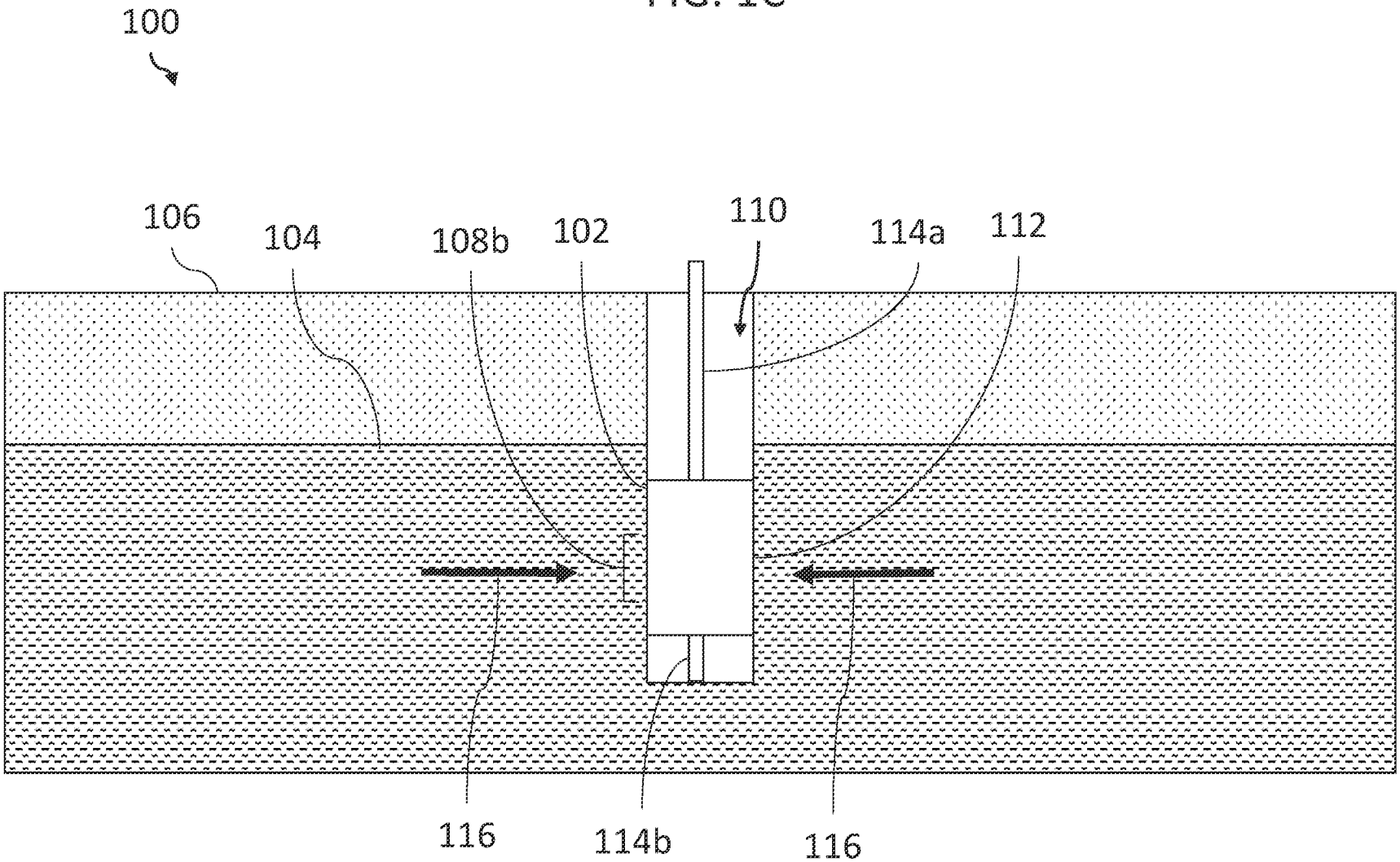
FIG. 1C depicts the 3D radial probe intersecting the target interval of the wellbore of FIG. 1B, with the radial probe expanded to eliminate dead volume between the probe and the wellbore.

With reference to FIG. 1B, in this exemplary embodiment target interval 108*b* has been selected for fluid sampling. The method includes subjecting the selected interval 108*b* of wellbore 102 to a draw-down to draw or bring a target phase into closer proximity to wellbore 102 and/or within wellbore 102. That is, fluid within the formation 104, such as oil, is sucked, pumped, or otherwise encouraged to flow from within formation 104 towards wellbore 102 and/or into cavity 110 of wellbore 102. In some such embodiments a 3D radial probe, such as the Saturn 3D radial probe by Schlumberger, is used to subject interval 108*b* to a relatively high draw-down to bring the target phase closer to or into wellbore 102. For example, as shown in FIG. 1B, 3D radial probe 112 is coupled with, integrated into, or a portion of string, between upper string portion 114*a* and lower string portion 114*b*. For clarity and simplicity, the entire string is not shown. When 3D radial probe 112 is actuated, formation fluid 116 within interval 108*b* is drawn towards and/or into wellbore 102, as indicted via the arrows in FIG. 1B.

Figure 2:
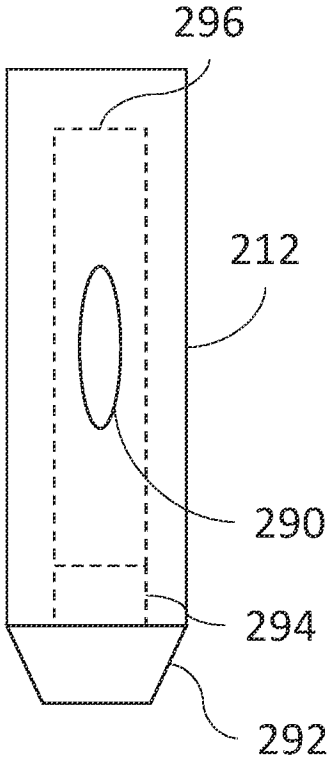
FIG. 2 depicts a simplified schematic of a 3D radial probe.

With reference to FIG. 2, a simplified schematic of one non-limiting, exemplary 3D radial probe is shown. 3D radial probe 212 includes inner bladder 296, drain assembly 294, spring loaded retract mechanism 292, and elliptical suction port 290. While the embodiment in FIG. 2 is shown as including a "spring loaded" retract mechanism, the probes disclosed herein are not limited to such a retract mechanism, and may include hydraulic retract mechanisms (e.g., including rods attached to a hydraulic mechanism) for retracting the probe or other retract mechanisms. With probe 212 positioned at the desired location within a wellbore, adjacent a target interval, inner bladder 296 is filled with fluid to expand drain assembly 294. As a result of this expansion, elliptical suction port 290 self-seals against the adjacent formation. Thus, the inlets of the 3D radial probe may extend into the formation such that there is no dead space between the 3D radial probe inlet and the formation. Suction is then applied to the formation through elliptical suction port 290, causing filtrate and hydrocarbons to flow from formation into elliptical suction port 290; thereby, sampling formation fluids. Drain assembly 294 is then contracted by draining the fluid from inner bladder 296. Spring loaded retract mechanism 292 may be used to retract probe 212. The 3D radial probe 112 is shown expanded in FIG. 1C such that there is no dead volume between the inlet(s) of the probe and the walls of the wellbore 102.

While the initial draw down of formation fluid is described as being performed with a 3D radial probe, the methods disclosed herein are not limited to use of a 3D radial probe and may use other probes or tools capable of drawing in formation fluid towards and/or into a wellbore.

Without being bound by theory, it is believed that the initial drawing in of formation fluid 116 towards and/or into wellbore 102 avoids or mitigates an unfavorable mobility ratio that would, in the absence of this initial drawing of formation fluid 116, result in only invasion fluid (injectant) being moved while subsequently pumping to collect samples. The "mobility ratio" refers to the mobility of an injectant divided by the mobility of fluid the injectant is displacing, such as oil. Therefore, it is believed that this initial drawing in of formation fluid 116 towards and/or into wellbore 102 helps to ensure that oil is being subsequently sampled, rather than other fluids.

Figure 1D:
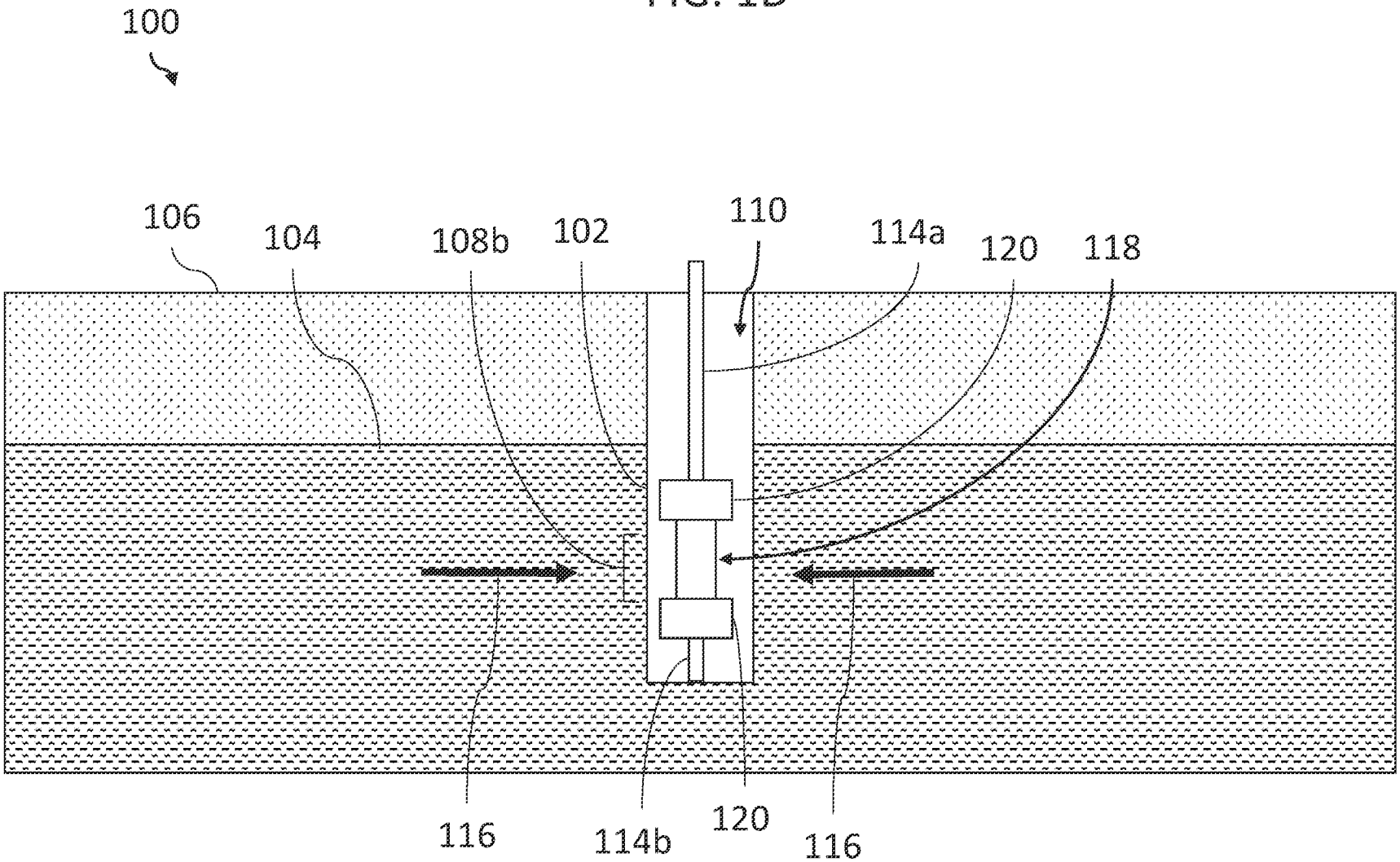
FIG. 1D depicts a straddle packer intersecting the target interval of the wellbore of FIG. 1C.

With reference to FIG. 1D, after the initial drawdown, 3D radial probe 112 is retracted. String 114*a*, 114*b*, with straddle packer assembly 118 incorporated therein, is positioned within wellbore 102 such that straddle packer assembly 118 intersects the same interval 108*b* as was previously intersected via probe 112. Straddle packer assembly 118 includes two expandable members 120, which may be expandable via inflation, compression, swelling, or another mechanism. In FIG. 1D, straddle packing assembly 118 is shown in a non-expanded configuration. Straddle packer assembly 118 may be run into wellbore 102 on wireline, pipe or coiled tubing. Straddle packer assembly 118 may be a single port packer, having a single inlet for receipt of fluid therein for sampling. For the purpose of simplicity, probe 112 is not shown in in conjunction with packer 118 on string 114*a*, 114*b*. However, probe 112 and packer 118 are, or at least may be, on the same toolstring, and set in the toolstring in sequence. For example, first probe 112 may be positioned adjacent the target interval for pumping, then probe 112 is deflated, and then packer 118 is positioned adjacent the target interval, such as by moving the toolstring upwards. After positioning of packer 118, packer is inflated and pumping using packer 118 may begin. Thus, the fluid is pumped using two different inlets on the same toolstring (i.e., the inlet of probe 112 and the inlet of packer 118).

Figure 1E:
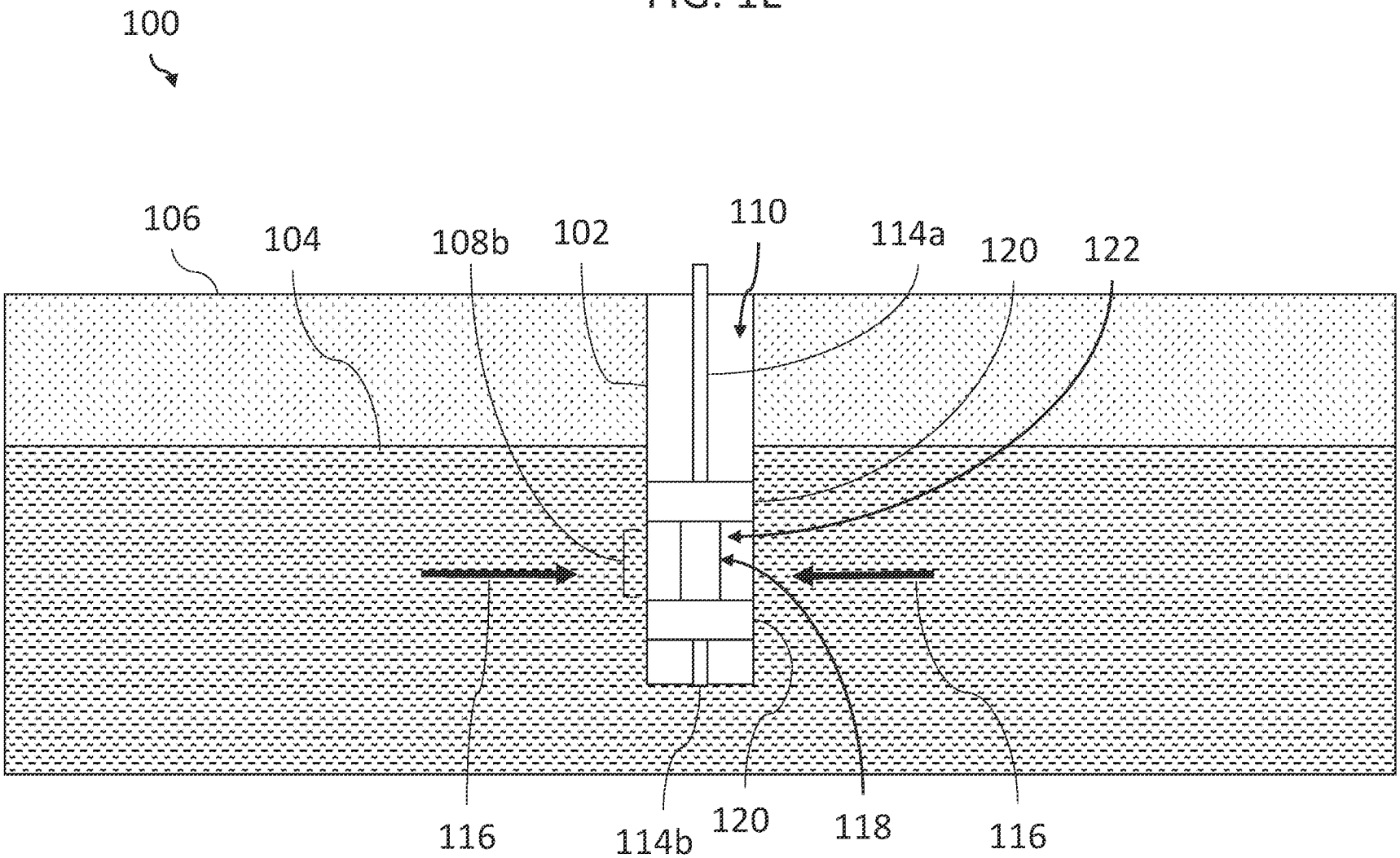
FIG. 1E depicts the straddle packer intersecting the target interval of the wellbore of FIG. 1D, with the straddle packer expanded.
Figure 3B:
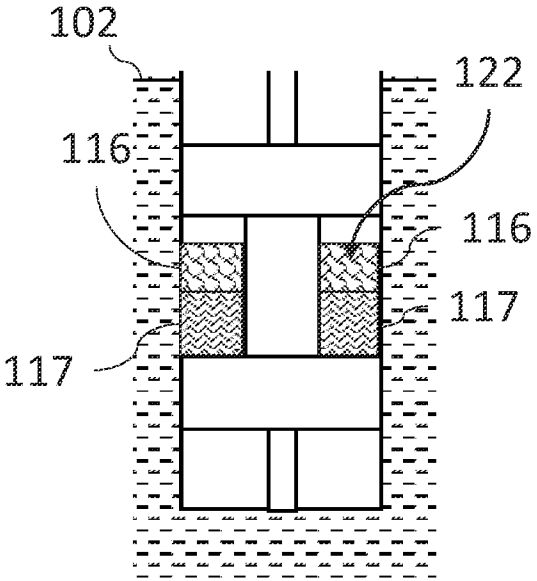
FIG. 3B depicts the portion of the target interval of the wellbore of FIG. 3A with the fluid mixture separated into two immiscible phases.
Figure 3A:
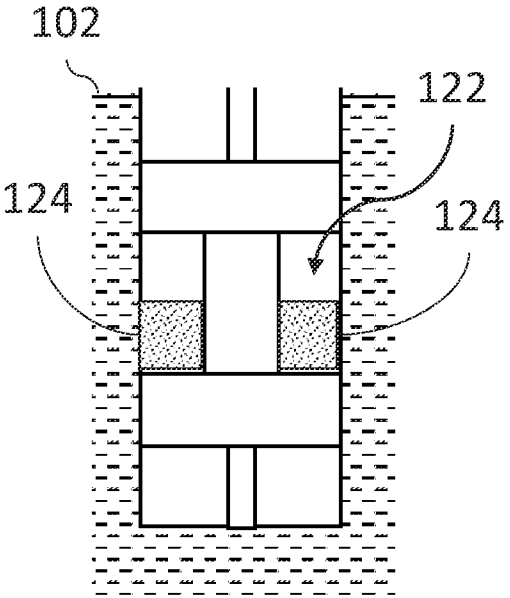
FIG. 3A depicts a portion of the target interval of the wellbore of FIG. 1D with an unsegregated fluid mixture contained within the section of wellbore that is isolated by the straddle packer.

In FIG. 1E, straddle packing assembly 118 is shown in an expanded configuration, such that expandable members 120 are expanded to engage with the walls of wellbore 102. With expandable members 120 expanded, straddle packing assembly 118 isolates a section (volume) of wellbore 102 from the remainder of wellbore 102 by sealing against the sides of wellbore 102, defining isolated wellbore section 122. As shown in FIG. 1E, isolated wellbore section 122 at least partially overlaps with target interval 108*b*. Isolation of wellbore section 122 provides dead volume (space) for filtrate and formation fluid 116 to flow into wellbore section 122, and to segregate therein. That is, the dead volume or space between the single inlet in the packer 118 and the wellbore 102 provides the space. Fluid 116 flows into wellbore section 122 and resides therein for a residence time, where filtrate and formation fluid separate. In some embodiments, filtrate and formation fluid separate due to the immiscibility of aqueous and non-aqueous phases and/or due to the action of gravity upon the fluids. That is, the filtrate may be water-based and the formation fluid may be hydrocarbon or hydrocarbon-based, such as oil or natural gas. With sufficient residence time within wellbore section 122, the aqueous and non-aqueous phases will separate. With reference to FIGS. 3A and 3B, a detailed view of a portion of wellbore section 122 is shown. In FIG. 3A, fluid mixture 124, including filtrate and formation fluid, is shown. FIG. 3B shows the same wellbore section 122, after a residence time has passed that is sufficient to allow formation fluid 116 to separate from other fluids 117. For example, formation fluid 116 may be hydrocarbon or hydrocarbon-based fluid, and fluids 117 may water or water-based (e.g., WBM). In some embodiments, pumping is used to encourage the flow of formation fluid 116 into wellbore section 122 during the residence time. As used herein "water-based phase" refers to a fluid (e.g., liquid) phase that is predominately (e.g., majority) aqueous, and "hydrocarbon-based phase" refers to a liquid or gas phase that is predominately (e.g., majority) hydrocarbon (e.g., oil or natural gas). In some embodiments involving natural gas drilling operations, when separating a natural gas phase from an aqueous phase, the residence time may be provided in the annular space (wellbore section 122) to separate natural gas from water. In some such embodiments, the natural gas and water separate at least partially as a result of the difference in density between the natural gas and the water-phase. That is, the water phase is denser than the natural gas phase, such that the water phase flows downward in wellbore 102 and the natural gas phase is segregated from the water phase and flows upward in wellbore 102. In some embodiments, the residence time is provided while pumping fluid mixture 124 from formation 104. Once fluid mixture 124 enters the annular space (wellbore section 122), at least a majority of the hydrocarbon (e.g., oil) will move upwards within wellbore section 122 due to gravity and/or immiscibility and/or density differential, and at least a majority of the WBM will move downwards, toward the inlet port of packer 118. In some embodiments, the inlet port of packer 118 is positioned at ⅓ or about ⅓ of the distance between members 120 of packer, as measured from the bottom end of packer 118 (i.e., from the top of the lower member 120).

Figure 3C:
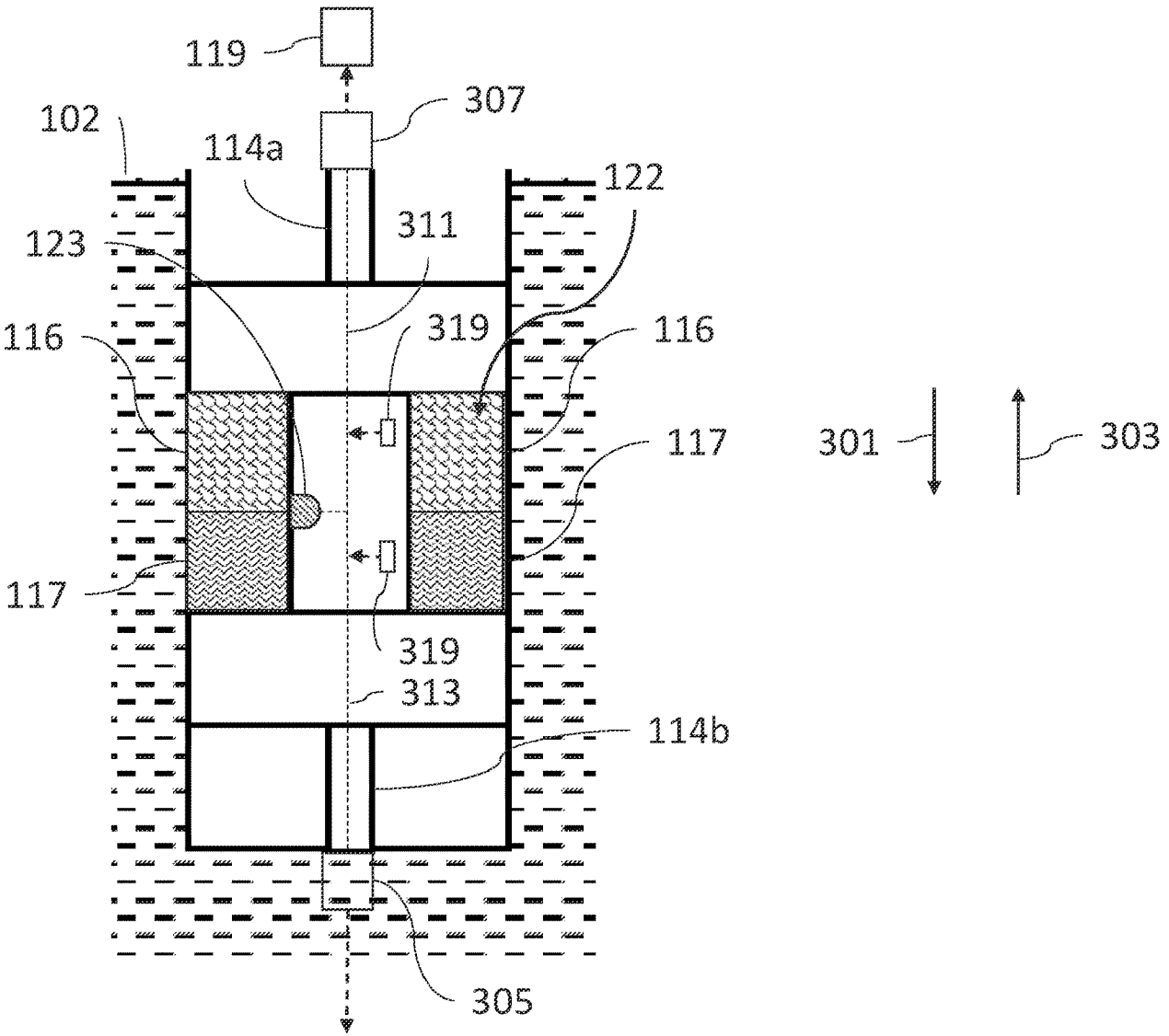
FIG. 3C depicts the portion of the target interval of the wellbore of FIG. 3B with pumps simultaneously pumping the two immiscible phases at a given pump rate ratio.

After the residence time has passed a sample of formation fluid 116 may be taken. In some embodiments, the sample of formation fluid 116 is taken via during a rate-controlled pumping period. In some such embodiments, the pumping includes using a simultaneous two-pump technique to collect the segregated formation fluid and discard the mud filtrate. With reference to FIG. 3C, once a sufficient volume of hydrocarbon fluid has been pumped to reach straddle packer inlet 123, the two-pump technique may be used to pull the WBM filtrate 117 in a downward direction 301 via lower pump 305, while the hydrocarbon, formation fluid 116, is "skimmed up" using upper pump 307. In some such embodiments, WBM filtrate 117 is pumped downward at a high pump rate while formation fluid 116 is skimmed up in direction 303 at a low pump rate. The segregated hydrocarbon, formation fluid 116, is collected in sampling recipients 119 located in upper part of string 114*a*. The pump rates disclosed here are defined relative to one another. That is, the pumping of the WBM filtrate 117 via pump 305 at a "high" rate refers to the fact that the rate is higher than the rate at which the hydrocarbon is pumped via pump 307. The "pump rate" refers to the volumetric flow rate of the pumps. In some embodiments, the two-pump technique disclosed herein exhibits a pump rate differential that is defined as the ratio of the pump rate of lower pump 305 to the pump rate of upper pump 307. In some such embodiments, the pump rate differential is at least 2/1 (i.e., the pump rate of lower pump 305 is at least twice that of the pump rate of upper pump 307), or at least 3/1, or at least 4/1, or at least 5/1, or at least 10/1.

While the hydrocarbon is pumped via pump 307 upwards, at least some of the hydrocarbon may still be pumped downwards along with the WBM filtrate 117.

After and/or coincident with the collection and/or the pumping of formation fluid 116 into sampling recipients 119, formation fluid 116 may be tested. For example, formation fluid 116 may be tested to determine the hydrocarbon content thereof (e.g., a weight percentage or volume percentage). In some embodiments, the testing includes spectroscopy, such as fluorescence spectroscopy. Formation fluid 116 may be tested in real-time, simultaneously while the formation fluid 116 is being pumped and/or collected. For example, formation fluid 116 may be tested using a downhole fluid analyzer, such as Schlumberger's InSitu Fluid Analyzer real-time downhole fluid analysis (DFA) system, which integrates various sensors making quantitative fluid properties measurements to provide a comprehensive characterization of formation fluid 116 at reservoir conditions. In some such embodiments, both fluid streams flowing upward (fluid stream 311 in FIG. 3C) and flowing downward (fluid stream 313 in FIG. 3C) are scanned by downhole fluid analyzers 319 (shown in FIG. 3C) to obtain fluid fraction information therefrom. In some embodiments, the scanning of fluid streams 311 and 313 is performed continuously or continually. In some embodiments, the fluid fraction information (e.g., percentage of hydrocarbon and/or water) is interpreted from the data collected by analyzers 119 in real-time (continuously or continually) to determine the optimum time to collect fluid samples therefrom.

Without being bound by theory, it is believed that the combination of tool inlets (i.e., the inlets of probe 112 and that of packer 118) used in the present method, both with dead volume (i.e., packer 118) and without dead volume (i.e., probe 112), can assist to displace the mud filtrate 117, bring the target phase (formation fluid 116) closer to the wellbore 102, and allow for collection of relatively high-quality samples after the formation fluid 116 is segregated via the action of gravity at the wellbore 102. Furthermore, it is believed that, with the packer 118 set at the target interval, the cleanup period that the annular space between the packer 118 and the wellbore 102 (i.e., the space defined by isolated wellbore section 122) provides a sufficient residence time to both phases of the fluid therein, such that the isolated wellbore section 122 acts as a segregation chamber for the fluid. "Cleanup" refers to a period when fluids are coming out of the formation and into the wellbore. During this time, the skin effect changes, such that well test results may reflect temporary obstructions to flow that will not be present in later tests.

The ability to segregate the WBM from the formation fluid provides for more accurate determinations of the fluid contents of the wellbore and intervals thereof. More accurate determinations of the fluid contents provide for the ability to determine which wellbores and which intervals thereof are more viable for hydrocarbon production. The present disclosure provides for the use of downhole residence time, using a wellbore coupled with dual pump action, to separate hydrocarbons from WBM filtrate through a single probe inlet. Without being bound by theory, it is believed that embodiments of the sampling techniques disclosed herein, including those using current formation tester capabilities, are capable of collecting relatively high-quality samples in wells where such high-quality sample collection has previously been thought to be challenging or impossible. Formation testers include tools run on wireline to obtain fluid samples and measure formation pressures. Formation testers are sometimes referred to as wireline formation testers. Formation testers include tool run on an electric logging cable that push probes into the formation, which then allows production into a closed chamber. While formation fluid is discussed herein as including oil, formation fluid may include any fluid that occurs in the pores of a rock, including oil, natural gas and water.

While the methods disclosed herein have been described with reference to obtaining and analyzing fluid samples in wells drilled using WBM, the methods disclosed herein are not limited to such wells. For example, in some embodiments the methods disclosed herein are used in wells drilled with oil-based mud. Oil-based mud is an invert-emulsion mud, or an emulsion whose continuous phase is oil. In such embodiments, the same method and procedure nay be implemented to obtain and test samples of fluid, with the exception that the fluid flowing downwards (e.g., fluid stream 313 in FIG. 3C) is collected instead of the fluid flowing upwards (e.g., fluid stream 311 in FIG. 3C).

Figure 4A:
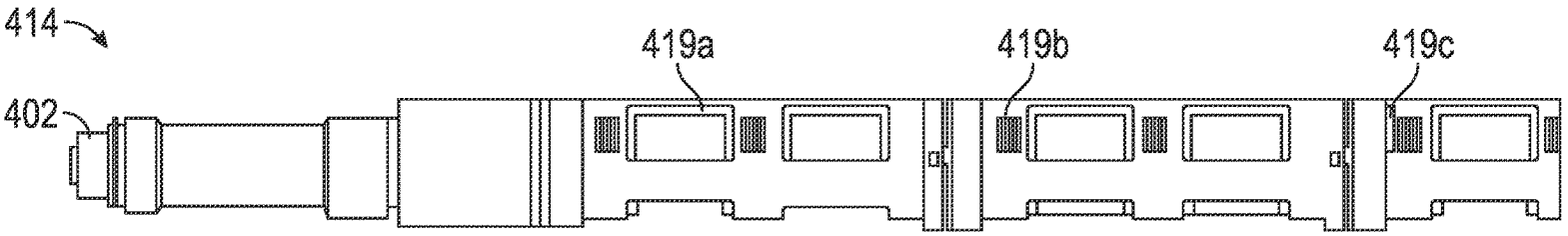
FIGS. 4A-4C depict sequential sections of a downhole string.
Figure 4B:
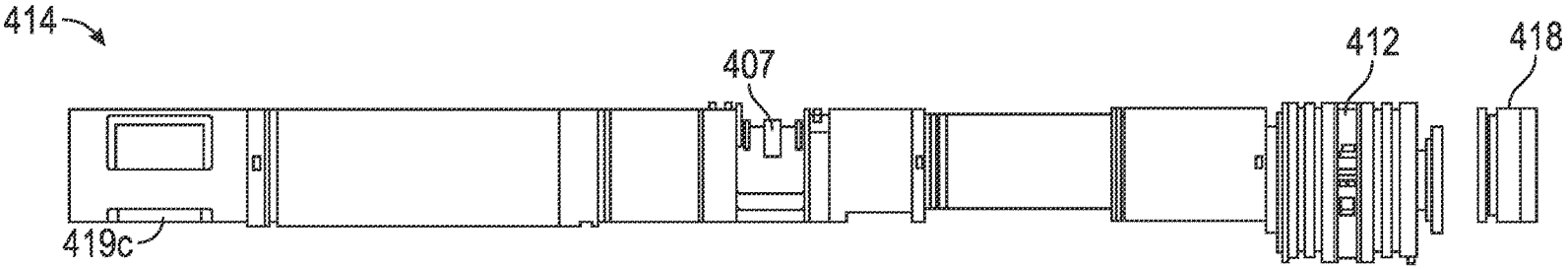
Figure 4C:
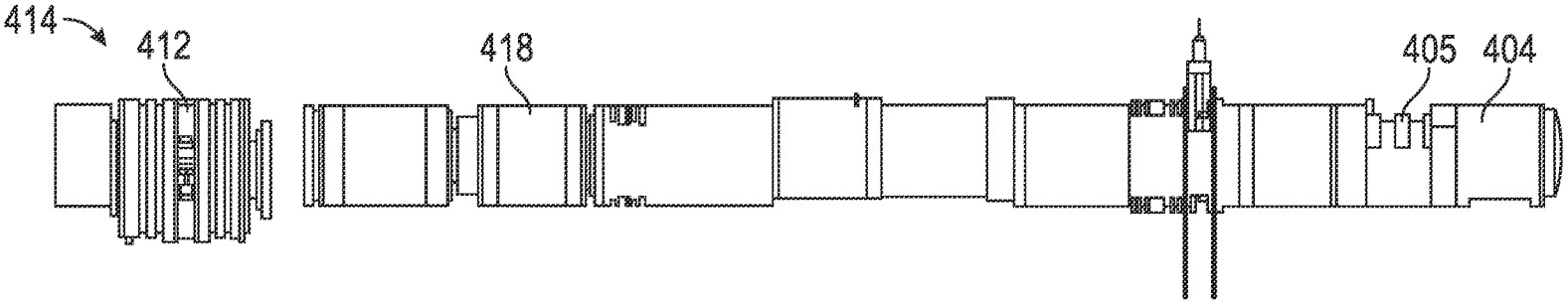
Figure 4D:
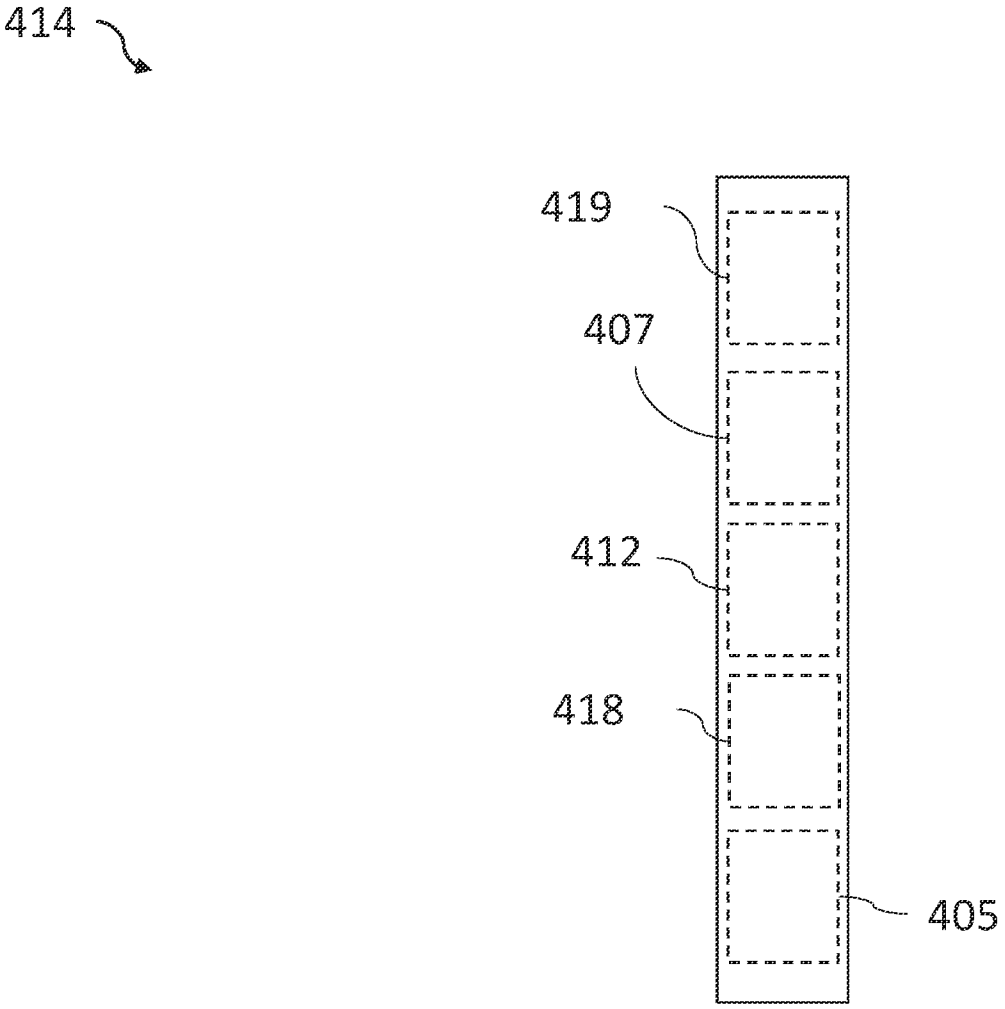
FIG. 4D depicts a downhole string.

FIGS. 4A-4C depict sequential sections of one exemplary downhole string, from a top end 402 of string 414 to a bottom end 404 of string 414. String 414 includes sample capture sections 419*a*-419*c*, pump 407 for pumping at a relatively a low pump rate, 3D radial probe 412, straddle packer 418, and pump 405 for pumping at a relatively high pump rate. String 414 is shown in sections for clarity. However, it would be clear to one skilled in the art that string 414 is a unified structure, with the sections shown in FIGS. 4A-4C connected together. FIG. 4D depicts a simplified schematic of a string including the various components that may be used to implement the methods disclosed herein.

Figure 5:
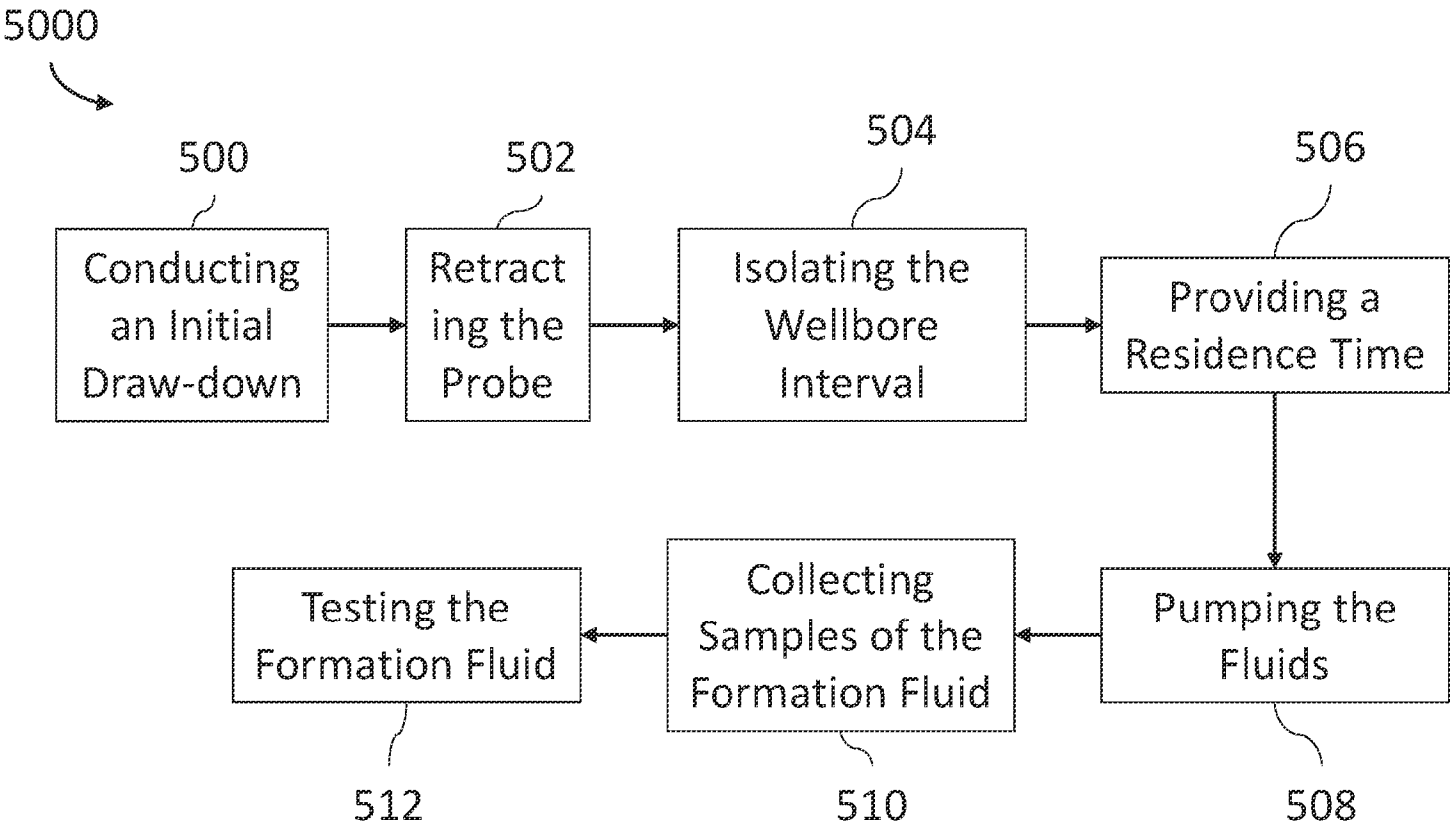
FIG. 5 is a flow chart of a fluid sampling method using a two-step process.

FIG. 5 depicts an exemplary flow chart of a method for sampling formation fluid using a two-step process (i.e., using a first probe for an initial drawdown, and then using a second, different probe for a subsequent pumping stage). Fluid sampling method 5000 includes conducting an initial draw-down 500 at a target interval in a wellbore. For example, a 3D radial probe may be lowered on a wireline into the wellbore to intersect the target interval, and may be activated to draw in formation fluids from the formation into the wellbore. Fluid sampling method 5000 includes retracting probe 502. Fluid sampling method 5000 includes isolating a wellbore interval 504 that is at least partially coincident with the target interval. For example, a straddle packer assembly may be used to isolate the wellbore interval. Fluid sampling method 5000 includes provide a residence time 506, such that the formation fluid can separate from the WBM due to gravity and/or immiscibility and/or density differential. Fluid sampling method 5000 includes pumping the fluids, 508. For example, the separated formation fluid can be pumped upwards and the WBM can be pumped downwards. Fluid sampling method 5000 includes collecting samples of the formation fluid, 510. Fluid sampling method 5000 includes testing the formation fluid 512. For example, the formation fluid can be tested to determine the hydrocarbon content thereof.

Figure 6:
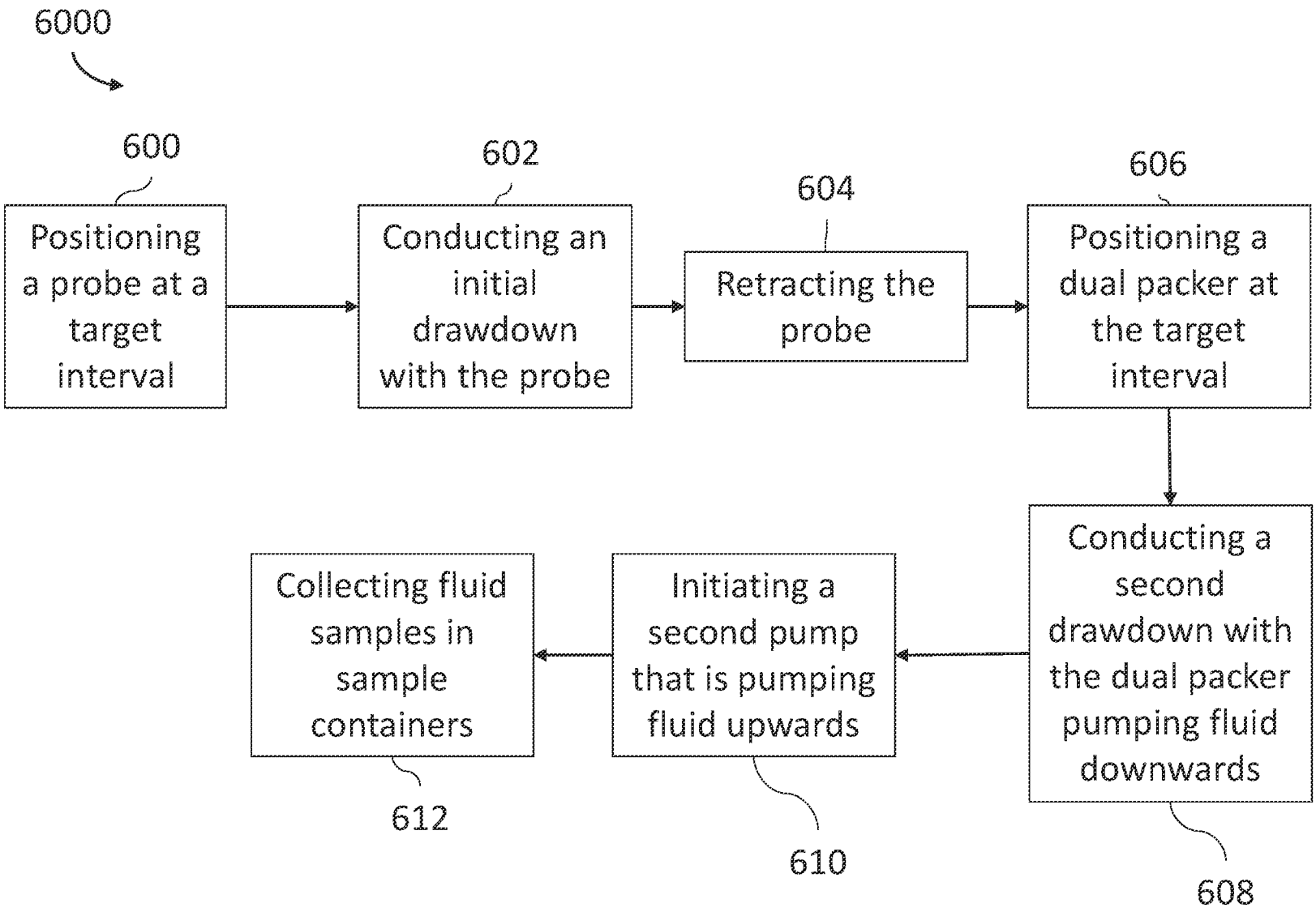
FIG. 6 is another flow chart of a fluid sampling method using a two-step process.

FIG. 6 depicts another exemplary flow chart of a method for sampling formation fluid using a two-step process. Fluid sampling method 6000 includes positioning a probe at a target interval, 600. For example, a 3D radial probe, such as a Saturn Probe, may be positioned within a wellbore to intersect the target interval. Fluid sampling method 6000 includes conducting an initial drawdown with the probe, 602. For example, a Saturn Probe may be used, with a single pump, to pump fluid either upwards or downwards in the wellbore. Fluid sampling method 6000 includes retracting the probe, 604. Fluid sampling method 6000 includes positioning a dual packer at the target interval, 606. Fluid sampling method 6000 includes conducting a second drawdown with the dual packer pumping fluid downwards, 608. For example, the dual packer may use a single pump to pump fluid downwards at a first pump rate. The phases of the fluid will segregate in the annular space of the dual packer during the pumping. In some applications it only takes seconds (less than one minute) for segregation to occur. Thus, while FIG. 5 includes providing a residence time for segregation as a separate step, this step may occur simultaneously and coincidently with the pumping. Fluid sampling method 6000 includes initiating a second pump that is pumping fluid upwards, 610. The second pump pumps fluid upwards at a slower pump rate than does the first pump. Fluid sampling method 6000 includes collecting fluid samples in sample containers, 612.

Figure 7:
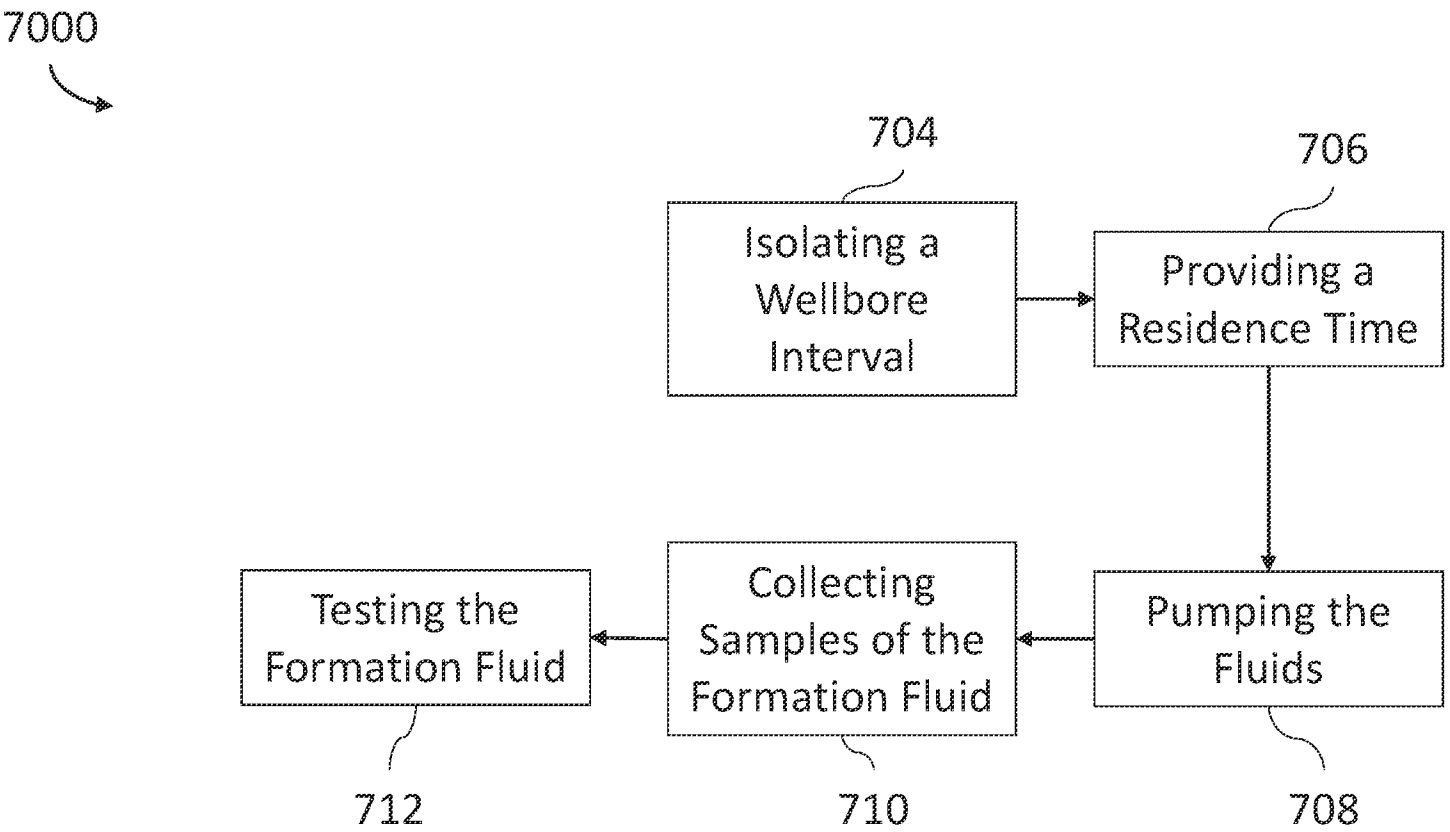
FIG. 7 is a flow chart of a fluid sampling method using a one-step process.

FIG. 7 depicts an exemplary flow chart of a method for sampling formation fluid using a one-step process (i.e., using a single probe for both initial drawdown and subsequent pumping/sampling stage). Fluid sampling method 7000 includes isolating a wellbore interval 704 that is at least partially coincident with the target interval. For example, a straddle packer assembly may be used to isolate the wellbore interval. Fluid sampling method 7000 includes provide a residence time 706, such that the formation fluid can separate from the WBM due to gravity and immiscibility. Fluid sampling method 7000 includes pumping the fluids, 708. For example, the separated formation fluid can be pumped upwards and the WBM can be pumped downwards. Fluid sampling method 7000 includes collecting samples of the formation fluid, 710. Fluid sampling method 7000 includes testing the formation fluid 712. For example, the formation fluid can be tested to determine the hydrocarbon content thereof.

Figure 8:
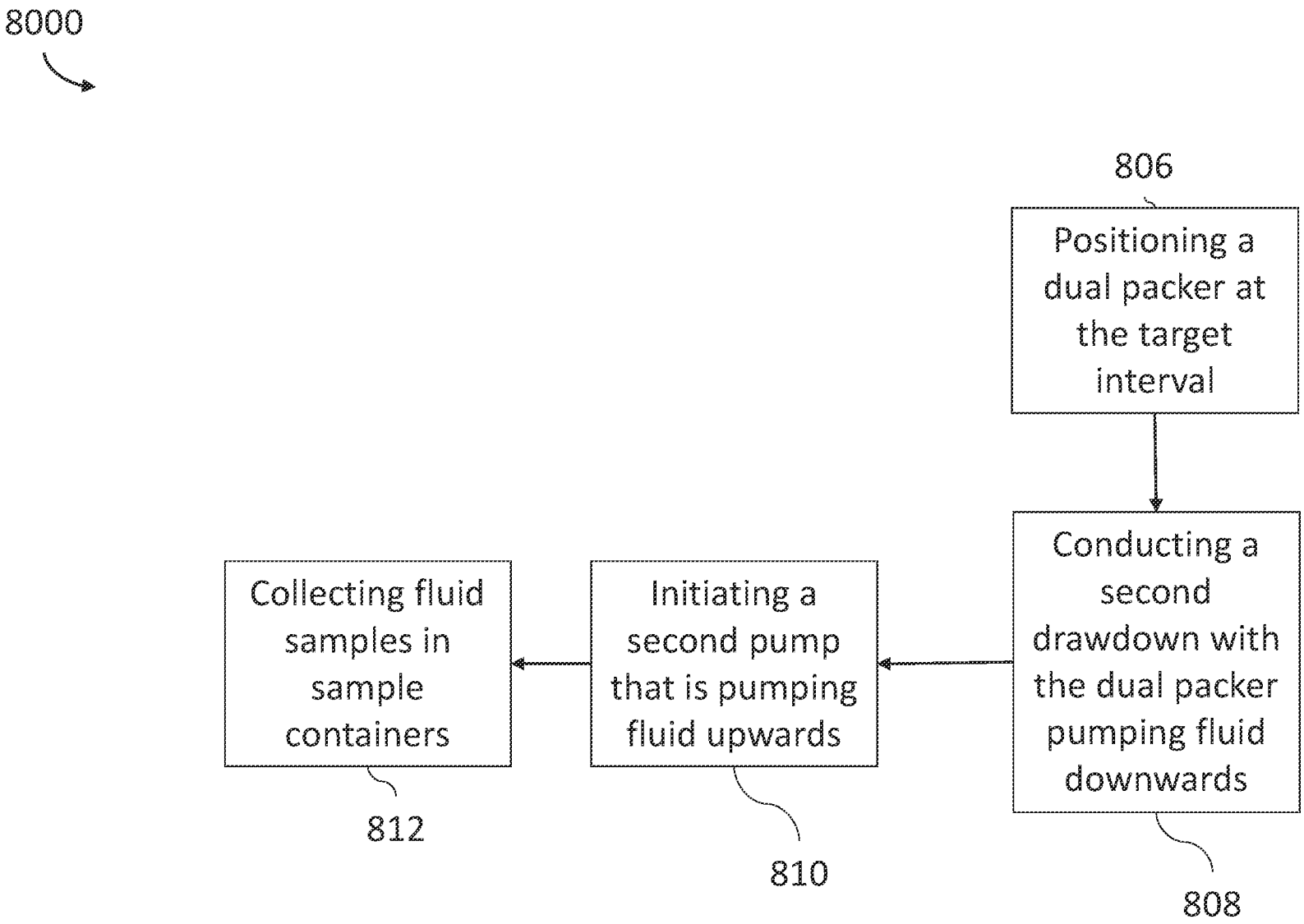
FIG. 8 is another flow chart of a fluid sampling method using a one-step process.

FIG. 8 depicts another exemplary flow chart of a method for sampling formation fluid using a one-step process. Fluid sampling method 8000 includes positioning a dual packer at the target interval, 806. Fluid sampling method 8000 includes conducting a second drawdown with the dual packer pumping fluid downwards, 808. For example, the dual packer may use a single pump to pump fluid downwards at a first pump rate. The phases of the fluid will segregate in the annular space of the dual packer during the pumping. In some applications it only takes seconds (less than one minute) for segregation to occur. Thus, while FIG. 7 includes providing a residence time for segregation as a separate step, this step may occur simultaneously and coincidently with the pumping. Fluid sampling method 8000 includes initiating a second pump that is pumping fluid upwards, 810. The second pump pumps fluid upwards at a slower pump rate than does the first pump. Fluid sampling method 8000 includes collecting fluid samples in sample containers, 812.

FIGS. 5-8 depicts several exemplary methods. However, the method disclosed herein is not limited to being implemented using these exact steps is the exact orders as shown in FIGS. 5-8. Certain steps may be eliminated, certain steps may be added, certain steps may occur at least partially coincident with other steps, and the order of certain steps may be rearranged. For example, in some embodiments a two-step process in used to take and analyze fluid samples, such as is shown in FIGS. 5 and 6. In a two-step process (dual-step process), an initial pump (e.g., using a Saturn probe) is carried out, followed by pumping using a second pump with the target interval isolated (e.g., using a straddle packer). Without being bound by theory, it is believed that use of a two-step process reduces the time that it takes to bring the target hydrocarbon phase into the wellbore to obtain and analyze fluid samples, in comparison to a one-step process. Regardless, in some embodiments a one-step process is used to obtain and analyze fluid samples, such as is shown in FIGS. 7 and 8. In a one-step process (single-step process), the initial pumping to bring the target hydrocarbon phase into the wellbore and the subsequent pumping to obtain and analyze fluid samples is conducted using the same fluid tester (e.g., using a straddle packer).

Applications

The methods, apparatus, and systems disclosed herein may be used to collect samples of formation fluid. In certain applications, the methods, apparatus, and systems disclosed herein may be used to collect fluid samples in wells in relatively low-permeability formations that have been drilled with WBM, including those with severe skin damage. For example, the methods, apparatus, and systems disclosed herein may be used to collect samples of formation fluid form wells on the north slope of Alaska.

In some embodiments, fluid sampling method disclosed herein may be used to assess the quantity and producibility of fluids from a reservoir. Information obtained from such fluid sampling methods may be used to guide wellsite decisions, such as placement of perforations and hydraulic fracture stages, and reservoir development and production planning.

In some embodiments, the fluid samples taken in accordance with the present disclosure, such that the fluid has a residence time within an isolated dead volume prior to sampling, exhibit an increase in hydrocarbon fraction, relative to the hydrocarbon fraction in samples taken without providing a residence time to the fluid within an isolated dead volume prior to sampling. In some such embodiments, the hydrocarbon fraction of the fluid samples is increased from a percentage that is less than 50%, or less than 40%, or less than 30%, or less than 20%, or less than 10%, or 5% or less to a percentage that is at least 50%, at least 60%, or least 70%, at least 80%, at least 90%, or at least 95% (where each % is a weight percent, wt. %). In some embodiments, the hydrocarbon fraction of a fluid sample is increased by a factor of 20. That is, the measured hydrocarbon percentage of a fluid may be 4.5 wt. % when using a probe that has no dead volume, but the measured hydrocarbon percentage measured of the same fluid may be 90 wt. % when subsequently using a probe with dead volume that provides residence time to the fluid prior to sampling. In some such embodiments, the hydrocarbon fraction of the fluid samples is increased by a factor of 20, 18, 15, 12, 10, 8, 5, or 2. In one example, a maximum hydrocarbon fraction in a fluid sample may be 5 wt. % when using probes that have no dead volume, whereas, samples from the same well may have hydrocarbon fractions increased to 90 wt. % by subsequently using probes with dead volume that provide residence time to the fluids prior to sampling with the pumps.

EXAMPLES

The following is one example of application of the fluid sampling method disclosed herein. However, the fluid sampling method is not limited to this particular application or these particular results.

A study was performed to assess the downhole fluid segregation and sampling methods disclosed herein. A wellbore was pumped at one interval using a Saturn 3D radial probe with no dead volume, and the maximum hydrocarbon fraction observed in the fluid samples obtained by the probe was 5 wt. % of sample. A hydrocarbon fraction of 5 wt. % is suboptimal for the sample volumes. A straddle packer was then set immediately after use of the probe, at the same depth with the wellbore. The cleanup period demonstrated that the annular space between the tool (the straddle packer) and the wellbore was providing a residence time to both phases on the fluid therein. Thus, the annular space between the tool (the straddle packer) and the wellbore was acting as a segregation chamber for the fluid therein. Lab results confirmed that the fluid samples collected without residence time contained 95 wt. % WBM filtrate, while the bottles (samples) collected with the proposed technique, utilizing the residence time, contained 90 wt. % hydrocarbon. Thus, the methods disclosed herein may be used to collect relatively high-quality fluid samples with wireline formation testers in wells drilled with WBM having severe skin damage.

EMBODIMENTS

Certain, non-limiting, embodiments will now be set forth.

Embodiment 1. A method for sampling fluid from a subterranean formation that is intersected by a wellbore, the method comprising: isolating a section of the wellbore with a fluid tester, the fluid tester including an inlet, wherein isolating the section of the wellbore with the fluid tester includes providing a space between the inlet of the fluid tester and the subterranean formation; pumping a fluid mixture from the subterranean formation into the wellbore and into the inlet of the fluid tester, wherein during the pumping the fluid mixture enters the space and at least partially separates within the space into at least two phases, the at least two phases including a hydrocarbon-based phase and a water-based phase; when the hydrocarbon-based and water-based phases enter the inlet of the fluid tester, pumping a sample of at least a portion of the hydrocarbon-based phase with a first pump from the fluid tester inlet to a sample chamber and using a second pump to pump a remainder of fluid from the fluid tester inlet into the wellbore, wherein the second pump exhibits a higher pump rate than a pump rate of the first pump; and testing a hydrocarbon content of the sample.

Embodiment 2. The method of embodiment 1, wherein the fluid tester comprises a straddle packer having expandable members and the inlet is positioned between the expandable members, wherein isolating the section of the wellbore comprises expanding the expandable members of the straddle packer, and, when the expandable members are expanded, a dead volume between the inlet of the straddle packer and the subterranean formation defines the space.

Embodiment 3. The method of embodiment 1 or 2, wherein the straddle packer includes a single inlet.

Embodiment 4. The method of any of embodiments 1 to 3, further comprising, prior to isolating the section of the wellbore with the fluid tester, pumping fluid from the subterranean formation at the section of the wellbore using an initial fluid tester having an inlet.

Embodiment 5. The method of embodiment 4, wherein the initial fluid tester comprises a 3D radial probe.

Embodiment 6. The method of embodiment 4 or 5, wherein there is no dead volume between the inlet of the initial fluid tester and the subterranean formation during the pumping.

Embodiment 7. The method of any of embodiments 4 to 6, wherein a hydrocarbon content of fluid pumped by the initial fluid tester is less than 50 weight percent.

Embodiment 8. The method of any of embodiments 1 to 7, wherein the sample is pumped upwards towards a surface of the wellbore and the remainder of fluid is pumped downwards into the wellbore.

Embodiment 9. The method of any of embodiments 1 to 8, wherein a hydrocarbon content of the sample is at least 50%.

Embodiment 10. The method of any of embodiments 1 to 9, wherein a hydrocarbon content of the sample is at least 90%.

Embodiment 11. The method of any of embodiments 1 to 10, wherein the space acts as a segregation chamber such that the fluid mixture separates therein via gravity, immiscibility between hydrocarbon and water, density differentials between hydrocarbon and water, or combinations thereof.

Embodiment 12. The method of any of embodiments 1 to 11, wherein the sample is skimmed from a top of fluid entering the fluid tester and pumped via the first pump.

Embodiment 13. The method of any of embodiments 1 to 12, wherein the pump rate of the second pump is at least 2 times greater than the pump rate of the first pump.

Embodiment 14. The method of any of embodiments 1 to 13, wherein the pump rate of the second pump is at least 5 times greater than the pump rate of the first pump.

Embodiment 15. The method of any of embodiments 1 to 14, wherein the pumping of the first pump and the pumping of the second pump are performed simultaneously.

Embodiment 16. The method of any of embodiments 1 to 15, wherein testing the hydrocarbon content of the sample comprises performing spectroscopy on the sample.

Embodiment 17. The method of any of embodiments 1 to 16, wherein the testing of the hydrocarbon content of the sample is performed simultaneously while pumping.

Embodiment 18. The method of any of embodiments 1 to 17, wherein the fluid mixture comprises hydrocarbon and water-based mud.

Embodiment 19. The method of any of embodiments 1 to 18, wherein the wellbore is a wellbore having been drilled with water-based mud.

Embodiment 20. The method of any of embodiments 1 to 19, wherein the wellbore is a wellbore exhibiting skin damage.

Embodiment 21. The method of any of embodiments 4 to 20, the initial fluid tester is a wireline formation tester.

Embodiment 22. The method of any of embodiments 1 to 21, wherein the subterranean formation is a low-permeability formation.

Embodiment 23. The method of any of embodiments 4 to 22, wherein the initial fluid tester pumps fluid in the subterranean formation to bring hydrocarbons in the subterranean formation within or into closer proximity to the wellbore.

Embodiment 24. The method of any of embodiments 1 to 23, wherein the residence time is coincident with a cleanup period wherein fluid enters the wellbore from the subterranean formation.

Embodiment 25. The method of any of embodiments 1 to 7, 9 to 17 and 20 to 24, wherein the sample is pumped downward towards a surface of the wellbore and the remainder of fluid is pumped upwards into the wellbore.

Embodiment 26. The method of any of embodiments 1 to 7 and 9 to 19 and 20 to 25, wherein the fluid mixture comprises hydrocarbon and oil-based mud.

Embodiment 27. The method of any of embodiments 1 to 7 and 9 to 19 and 20 to 26, wherein the wellbore is a wellbore having been drilled with oil-based mud.

Embodiment 28. A method for sampling fluid from a subterranean formation that is intersected by a wellbore, the method comprising: performing an initial draw-down at a target interval in the wellbore, including pumping fluid from the subterranean formation using a first fluid tester; isolating the target interval of the wellbore with a second fluid tester, the fluid tester including an inlet, wherein a dead volume is present between the inlet of the second fluid tester and the subterranean formation; pumping a fluid mixture from the subterranean formation into the dead space and into the inlet of the second fluid tester, wherein during the pumping the fluid mixture at least partially separates within the dead space into at least two phases, the at least two phases including a hydrocarbon-based phase and a water-based phase; pumping a sample of at least a portion of the hydrocarbon-based phase with a first pump from the inlet of the second fluid tester to a sample chamber and using a second pump to pump a remainder of fluid from the inlet of the second fluid tester into the wellbore, wherein the second pump exhibits a higher pump rate than a pump rate of the first pump; and testing the sample to determine a hydrocarbon content of the sample.

Embodiment 29. A method for sampling fluid from a subterranean formation that is intersected by a wellbore, the method comprising: a) performing an initial draw-down at a first target interval in the wellbore, including pumping fluid from the subterranean formation using a first fluid tester; b) isolating the first target interval of the wellbore with a second fluid tester; c) pumping a fluid mixture from the subterranean formation and into a dead space between the subterranean formation and an inlet of the second fluid tester, wherein, during a residence time within the dead space, the fluid mixture containing mud and hydrocarbon separates into at least two phases that include a water-based phase and a hydrocarbon-based phase; d) pumping a first sample of the hydrocarbon-based phase into a sample chamber while pumping a remainder of the fluid into the wellbore; e) testing the first sample to determine a hydrocarbon content of the first sample; f) repeating steps 'a' through 'e' at a second target interval in the wellbore to determine a hydrocarbon content of a second sample; and g) comparing the hydrocarbon content of the first sample with the hydrocarbon content of the second sample.

Embodiment 30. The method of embodiment 29, further comprising: h) determining which of the first or second target intervals to produce hydrocarbons from based on the comparison between the hydrocarbon content of the first sample and the second sample.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the processes, machines, manufactures, apparatus, systems, compositions of matter, means, methods and steps described in the specification. As one of ordinary skill in the art will readily appreciate from the disclosure, processes, machines, manufactures, apparatus, systems, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufactures, apparatus, systems, compositions of matter, means, methods, or steps.

What is claimed is:

1. A method for sampling fluid from a subterranean formation that is intersected by a wellbore, the method comprising:

isolating a section of the wellbore with a fluid tester, the fluid tester including an inlet, wherein isolating the section of the wellbore with the fluid tester includes providing a space between the inlet of the fluid tester and the subterranean formation;

pumping a fluid mixture from the subterranean formation into the wellbore and into the inlet of the fluid tester, wherein during the pumping the fluid mixture enters the space and at least partially separates within the space into at least two phases, the at least two phases including a hydrocarbon-based phase and a water-based phase;

when the hydrocarbon-based and water-based phases enter the inlet of the fluid tester, pumping a sample of at least a portion of the hydrocarbon-based phase with a first pump from the fluid tester inlet to a sample chamber and using a second pump to pump a remainder of fluid from the fluid tester inlet into the wellbore, wherein the second pump exhibits a higher pump rate than a pump rate of the first pump; and testing a hydrocarbon content of the sample;

wherein the pump rate of the second pump is at least 2 times greater than the pump rate of the first pump;

wherein the fluid tester comprises a straddle packer having expandable members and the inlet is positioned between the expandable members, wherein isolating the section of the wellbore comprises expanding the expandable members of the straddle packer, and, when the expandable members are expanded, a dead volume between the inlet of the straddle packer and the subterranean formation defines the space;

wherein the straddle packer includes a single inlet; and further comprising, prior to isolating the section of the wellbore with the fluid tester, pumping fluid from the subterranean formation at the section of the wellbore using an initial fluid tester having an inlet.

2. The method of claim 1, wherein the initial fluid tester comprises a 3D radial probe.

3. The method of claim 2, wherein there is no dead volume between the inlet of the initial fluid tester and the subterranean formation during the pumping.

4. The method of claim 3, wherein a hydrocarbon content of fluid pumped by the initial fluid tester is less than 50 weight percent.

5. The method of claim 1, wherein the sample is pumped upwards towards a surface of the wellbore and the remainder of fluid is pumped downwards into the wellbore.

6. The method of claim 1, wherein a hydrocarbon content of the sample is at least 50%.

7. The method of claim 1, wherein a hydrocarbon content of the sample is at least 90%.

8. The method of claim 7, wherein the space acts as a segregation chamber such that the fluid mixture separates therein via gravity, immiscibility, between hydrocarbon and water, density differentials between hydrocarbon and water, or combinations thereof.

9. The method of claim 8, wherein the sample is skimmed from a top of fluid entering the fluid tester and pumped via the first pump.

10. The method of claim 1, wherein the pump rate of the second pump is at least 5 times greater than the pump rate of the first pump.

11. The method of claim 1, wherein the pumping of the first pump and the pumping of the second pump are performed simultaneously.

12. The method of claim 1, wherein testing the hydrocarbon content of the sample comprises performing spectroscopy on the sample.

13. The method of claim 1, wherein the testing of the hydrocarbon content of the sample is performed simultaneously while pumping.

14. The method of claim 1, wherein the fluid mixture comprises hydrocarbon and water-based mud.

15. The method of claim 1, wherein the wellbore is a wellbore having been drilled with water-based mud.

16. The method of claim 1, wherein the wellbore is a wellbore exhibiting skin damage.

17. A method for sampling fluid from a subterranean formation that is intersected by a wellbore, the method comprising:

isolating a section of the wellbore with a fluid tester, the fluid tester including an inlet, wherein isolating the section of the wellbore with the fluid tester includes providing a space between the inlet of the fluid tester and the subterranean formation;

pumping a fluid mixture from the subterranean formation into the wellbore and into the inlet of the fluid tester, wherein during the pumping the fluid mixture enters the space and at least partially separates within the space into at least two phases, the at least two phases including a hydrocarbon-based phase and a water-based phase;

when the hydrocarbon-based and water-based phases enter the inlet of the fluid tester, pumping a sample of at least a portion of the hydrocarbon-based phase with a first pump from the fluid tester inlet to a sample chamber and using a second pump to pump a remainder of fluid from the fluid tester inlet into the wellbore, wherein the second pump exhibits a higher pump rate than a pump rate of the first pump; and testing a hydrocarbon content of the sample;

further comprising, prior to isolating the section of the wellbore with the fluid tester, pumping fluid from the subterranean formation at the section of the wellbore using an initial fluid tester having an inlet.

* * * * *